US007277649B2

(12) United States Patent
Hirobe et al.

(10) Patent No.: US 7,277,649 B2
(45) Date of Patent: Oct. 2, 2007

(54) DEVELOPING APPARATUS AND IMAGE FORMING METHOD

(75) Inventors: Fumitake Hirobe, Ushiku (JP); Tadayoshi Nishihama, Abiko (JP); Akihiro Noguchi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 70 days.

(21) Appl. No.: 11/314,091

(22) Filed: Dec. 22, 2005

(65) Prior Publication Data

US 2006/0140651 A1 Jun. 29, 2006

(30) Foreign Application Priority Data

Dec. 24, 2004 (JP) ..... 2004/374426

(51) Int. Cl.
*G03G 15/08* (2006.01)

(52) U.S. Cl. ..... 399/27; 399/223; 399/227

(58) Field of Classification Search ..... 399/27, 399/399, 227, 257

See application file for complete search history.

(56) References Cited

U.S. PATENT DOCUMENTS

| | | | | |
|---|---|---|---|---|
| 6,498,910 | B2 * | 12/2002 | Haneda | 399/51 |
| 6,996,358 | B2 * | 2/2006 | Ayaki et al. | 430/45.4 |
| 2005/0042532 | A1 * | 2/2005 | Iida et al. | 430/45 |
| 2006/0029404 | A1 * | 2/2006 | Hirota et al. | 399/27 |
| 2006/0198662 | A1 * | 9/2006 | Fukuda et al. | 399/257 |

FOREIGN PATENT DOCUMENTS

| | | | |
|---|---|---|---|
| JP | 2-21591 | | 5/1990 |
| JP | 8-234550 | | 9/1996 |
| JP | 9-204105 | | 8/1997 |
| JP | 11-202630 | | 7/1999 |
| JP | 2000-231279 | | 8/2000 |
| JP | 2001060043 | A * | 3/2001 |

* cited by examiner

*Primary Examiner*—Quana Grainger
(74) *Attorney, Agent, or Firm*—Fitzpatrick, Cella, Harper & Scinto

(57) ABSTRACT

A developing apparatus for developing an electrostatic image with light chromatic toner and dark chromatic toner which have the same hue, the developing device includes a light color developing device for accommodating a developer containing the light chromatic toner and carrier to develop the electrostatic image; a dark color developing device for accommodating a developer containing the dark chromatic toner and carrier to develop the electrostatic image; light color developer supply container accommodating a developer containing the light chromatic toner and the carrier to be supplied to the light color developing device; and dark color developer supply container accommodating a developer containing the dark chromatic toner and the carrier to be supplied to the dark color developing device, wherein the developer in the light chromatic toner supply container and the developer in the dark chromatic toner supply container have carrier weight ratios which are different from each other.

8 Claims, 4 Drawing Sheets

DEVELOPING APPARATUS AND IMAGE FORMING METHOD

FIELD OF THE INVENTION AND RELATED ART

The present invention generally relates to an image forming apparatus such as a copying machine, a printer, etc. In particular, it relates to a developing apparatus employing a two-component developing method which uses two types of developer, that is, a toner which is high in color density (which hereinafter will be referred to as dark toner), and a toner which is low in color density (which hereinafter will be referred to as light toner). It also relates to an image forming method.

In the field of an image forming apparatus employing an electrophotographic image forming method, in particular, an image forming apparatus which forms a color image, a two-component developing method has been widely used, which uses a mixture of nonmagnetic and magnetic carrier, as developer.

Compared to the other developing methods which are presently in use, a two-component developing method is advantageous in terms of stability in image quality, apparatus durability, etc. On the other hand, it has its own weakness. That is, a body of two-component developer in a developing apparatus gradually deteriorates due to usage, more specifically, the carrier in the developer reduces in the amount of triboelectric charge (which hereinafter may referred to simply as tribo) it gives to toner. As a result, the two-component developer changes in its properties, resulting in such problems as the formation of an image suffering from color deviation, scattering of the developer, etc. Therefore, the two-component developer in an image forming apparatus employing a two-component developing method has to be replaced after a certain length of time.

As for the solutions to the above-described problems, Japanese Patent Application Publication Hei 2-21591 proposes a method for reducing the amount of work required for the developer replacement. According to this method, the deteriorated developer is automatically recovered little by little from a developing apparatus, and the developing apparatus is automatically replenished with fresh developer by the amount equal to the amount by which the deteriorated developer was recovered, so that the performance of the body of the developer in the developing apparatus is maintained within a certain range. Thus, this method is advantageous in that, with the deteriorated developer (carrier) gradually replaced by fresh developer, the apparent progression of the carrier deterioration stops. As a result, the body of the developer in the developing apparatus remains stable in overall properties, and also, that, with the developer automatically replaced, the manual operation for replacing the developer is unnecessary.

Further, Japanese Laid-open Patent Application Hei 8-234550 and Japanese Laid-open Patent Application Hei 11-202630 propose to render the carrier in the developer used in the initial period of a developing apparatus usage, different in physical properties, for example, electrical resistance and amount of triboelectric charge it gives to toner, from the carrier in the replenishment developer.

However, the rate of carrier deterioration is dependent upon the amount by which a developing apparatus is supplied with carrier. Therefore, as long as a conventional method for replenishing a developing apparatus with developer (carrier) is used, there is the problem that the rate of carrier deterioration substantially fluctuates in response to the amount by which a developing apparatus is supplied with toner, that is, it is affected by image ratio.

Thus, Japanese Laid-open Patent Application Hei 9-204105 proposes to provide a developing device with a carrier hopper, that is, a hopper through which only carrier is supplied to the developing device. With the provision of this hopper, the amount by which carrier is supplied to a developing device along with replenishment toner can be decided in proportion to image ratio.

However, this method requires to provide a developing device with a hopper dedicated to the supplying of carrier, in addition to the hopper for supplying toner. Further, a carrier hopper must be substantial in size. Therefore, this method is problematic in that it substantially increases an image forming apparatus in size.

On the other hand, Japanese Laid-open Patent Application 2000-231279 proposes an electrophotographic image forming apparatus which uses a greater number of developers than a conventional color image forming apparatus which uses four developers different in color, in order to improve the level of image quality at which an image is formed.

Admittedly, in the field of an ink jet image forming apparatus, image formation systems which use cyan and magenta inks which are lower in color density than ordinary cyan and magenta inks, in addition to the ordinary cyan and magenta inks, have been presented. These image formation systems, which use a toner which is lower in covering power than an ordinary toner with the same color, in addition to the ordinary toner, can yield an excellent image, that is, an image which is sharper in edges, less in color deviation, and superior in terms of graininess.

The extent of the above-described carrier deterioration can be expressed as the amount by which carrier is reduced in its ability to give toner particles triboelectric charge. More specifically, while carrier is in use, the agents with which carrier particles are coated are gradually shaved away, and also, toner and external additives adhere to the surfaces of toner particles. Therefore, the amount by which carrier can give toner particles triboelectric charge gradually reduces.

It is possible to prevent the carrier deterioration attributable to the above-described causes. However, the extent of carrier deterioration is greatly affected by the conditions under which carrier is used. More specifically, it is affected by the frequency with which a developing apparatus is supplied with carrier per unit number of outputs (copies), and the frequency with which deteriorated developer is discharged from a developing apparatus, and the frequency with which a developing apparatus is replenished with a fresh supply of carrier. To put it simply, the greater the frequency with which the developer in a developing apparatus is replaced by a preset amount, the higher the level at which the carrier particles in the developing apparatus stabilize in terms of average freshness. However, the greater the frequency of developer replacement, the higher the image formation cost, which is disadvantageous.

The above-described problems can be reduced by optimizing developer in carrier/toner ratio (C/D ratio), or the like.

However, an image forming operation in which a substantial number of copies, which are relatively high in image ratio, are continuously outputted, is greater in the amount of toner consumption than an image forming operation in which a substantial number of copies which are relatively low in image ratio are continuously outputted. Therefore, it is greater in the frequency with which a developing apparatus is replenished with toner, and therefore, it is greater in the amount by which a developing apparatus is supplied with carrier. Thus, in terms of the extent of the carrier deterioration in a developing device, the former operation is much better than the latter.

However, as described above, the former operation is greater in the carrier replacement frequency, being therefore undesirable from the standpoint of operational cost. In particular, in the case of a color image forming operation in which the monochromatic images, different in color, for the formation of a multicolor image are substantially different in image ratio, developing devices for developing the monochromatic images different in color, one for one, become different in the extent of carrier deterioration, that is, the amount by which carrier can frictionally charge toner. This is problematic in that it results in the formation of an image suffering from color deviation.

At this time, the relationship between the difference in image ratio and the difference in the extent of carrier deterioration will be described in detail. The length of time each carrier particle in a body of carrier is used per copy of A4 size in a developing means container is referred to as the "age" of the toner particle.

Then, the average age of the carrier particles in a developing means container after the completion of a duration test in which x number of copies are outputted is expressed as P(x).

Further, it is assumed that as each copy is yielded, a developing means container is replenished with a d (g) of fresh carrier in response to the toner consumption, and the developer which was in the developing means container is discharged by the same amount d (g). For calculation, it is assumed that the image formation and carrier replacement occur sequentially. Thus, immediately after the formation of x number of copies, the relationship between the average carrier age P(x) immediately before the carrier replenishment, and the average carrier age Q(x) after the carrier replenishment copies, is:

$$Q(x)=P(x)\times[(W-d)/W]+P(0)\times[d/W] \quad (1).$$

Here, P(0) is the average carrier age at the beginning of developer (carrier) usage. Therefore, P(0)=0. Therefore, $$Q(x)=P(x)\times[(W-d)/W] \quad (2).$$

The average carrier age after the formation of one more copy using the developer, the average carrier age of which is Q(x) is P(x+1). It is assumable that during the formation of this copy, the carrier particles in the developer are equally used. Therefore, $$P(x+1)=Q(x)+1 \quad (3).$$

From Equations (2) and (3), $$P(x+1)=P(x+1)\times[(W-d)/W]+1 \quad (4).$$

That is, $$P(x)=[1-(1-d/W)^x]*W/d \quad (5).$$

In other words, when the developer in a developing means container is automatically replaced by a preset amount, the average age of the carrier in the developing means container converges to W/d (= total amount of carrier in developing means container/amount of carrier replenishment per copy).

More specifically, when the amount of the developer in a developing means container is 375 g, and the toner content is 8%, the amount of the carrier in the developing means container is 350 g. Thus, if the amount by which toner is adhered to an image bearing member for achieving the highest level of image density is 0.7 mg/cm$^2$, and image ratio is 5%, 21.3 mg of toner is consumed per recording paper of A4 size, and the amount by which the carrier is replaced per recording paper of A4 size is 3.8 mg.

FIG. 3 is a graph showing the changes in the average ages of the carrier particles in a developing means container, which were calculated using the above given equation.

In the drawing, the dotted line represents the results of an image forming operation in which the carrier ratio in a replenishment developer was zero percent (C/D=0), that is, the amount of carrier in a replenishment developer was zero. Thus, the cumulative number of copies equals the average carrier age.

FIG. 3 also shows the results of the image forming operations in which image ratio was 10% and 50%, respectively, in addition to the results represented by the dotted line.

As will be evident from the drawing, in the case of the duration test in which the C/D ratio was 15% and image ratio was 5%, as the cumulative number of copies reaches 300,000, the average age of the carrier particles in a developing means container reaches 90,000, and roughly stabilizes. In comparison, in the case of the duration test in which the C/D ratio was 0%, as the cumulative number of copies reaches 300,000, the average age of the carrier particles in a developing means container reaches 300,000, at which the entirety of the body of developer in a developing means container had to be replaced, which was the case in the past.

It is also evident from the drawing that in terms of average carrier age, the image forming operation (duration test) in which image ratio was 5% was 10 times the image forming operation (duration test) in which image ratio was 50%.

There is a correlation between the average carrier age and the carrier performance in terms of the ability to give triboelectric charge to toner. Therefore, after the completion of the duration tests, there was a substantial difference in performance between the carrier used in duration test in which image ration was 5% and the carrier used in the duration test in which image ratio was 50%. This difference in the carrier performance, that is, the carrier's ability to give toner triboelectric charge, resulted in the formation of a defective image, that is, an image suffering from color deviation and/or fog.

As for the means for reducing the abovementioned average carrier particle age, it is possible to reduce the amount of the developer in the developing means container in order to reduce in length the intervals of developer replacement. This method increases the frequency of the developer replacement, effectively reducing thereby the actual average carrier particle age, by reducing the absolute amount of developer in the developing means container. For example, the average carrier particle age can be roughly halved by halving the amount of the developer in a developing means container. However, a method such as this one also reduces the absolute amount of toner in a developing means container, degrading the developer in a developing means container, in terms of the uniformity in the toner distribution in the developing means container, which is likely to result in such a problem as the formation of a defective image, the solid areas of which are nonuniform in density, and/or suffer from density deviation.

Further, in the case of the image forming system which uses dark toners, and light toners which are different in covering power from the dark toners, the areas of a latent image, which are to be covered with the light toners, are rendered roughly the same in potential level as the solid areas of the image. Therefore, the employment of the image forming system which uses dark and light toners can prevent the formation of an image suffering from minuscule white spots attributable to the electric field generated between a highlighted area and a solid area, making it possible to yield such an image that is excellent in that it does not suffer from unsightly graininess.

Further, by using the light toner, which is lower in covering power, the image density Y relative to the nonuniformity in potential level across highlighted areas can be reduced. Thus, the image forming system which uses dark and light toners is also effective to prevent the formation of an image, the highlighted areas of which suffer from color deviation.

However, when an image having halftone areas is formed with the use of the image forming system which uses light and dark toners, a resulting image will have areas covered with light toner and areas covered with dark toner. Therefore, how to control the process of forming the transitional area between an image area to be formed of the light toner and an area to be formed of the dark toner is important.

It has been known that when an image forming method which uses an ink jet or an electrophotographic image forming method is used, image formation data are generally analyzed as shown in FIG. 4, in which the axis of abscissas represents image ratio, and the axis of ordinates represents the amount by which the dark and light toners are adhered to recording medium, and which was obtained by the analysis. In other words, the axis of ordinates in FIG. 4 represents the amount of the toner consumption.

As will be evident from the above description, usually, the amount by which light toner is used is greater than the amount by which dark toner is used. More specifically, when a copy to be made is no more than 80% in image ratio, the amount by which light toner is used is greater than the amount by which dark toner is used. Therefore, the above-described problems occur.

To describe in more detail, if the dark and light developers are different in the extent of carrier deterioration, they become different in the amount of electrical charge which toner is given, becoming therefore different in the performance in terms of developing a latent image. Therefore, such a problem occurs that an image suffering from such an image defect that the transitional area (image area which is 40-80% in image ratio, in particular, image area which is 60% in image ratio) between an image area to be formed of light toner and an image area to be formed of dark toner has pseudo border lines and/or color deviation is formed.

SUMMARY OF THE INVENTION

Thus, the primary object of the present invention is to provide a developing apparatus which employs two-component toners different in color density (two-component dark toner and two-component light toner), and which is characterized in that it forms an image which does not suffer from color deviation, by preventing the dark toner and light toner from becoming different in developmental performance.

According to an aspect of the present invention, there is provided a developing apparatus for developing an electrostatic image with light chromatic toner and dark chromatic toner which have the same hue, said developing device comprising a light color developing device for accommodating a developer containing the light chromatic toner and carrier to develop the electrostatic image; a dark color developing device for accommodating a developer containing the dark chromatic toner and carrier to develop the electrostatic image; light color developer supply container accommodating a developer containing the light chromatic toner and the carrier to be supplied to said light color developing device; and dark color developer supply container accommodating a developer containing the dark chromatic toner and the carrier to be supplied to said dark color developing device, wherein the developer in said light chromatic toner supply container and the developer in said dark chromatic toner supply container have carrier weight ratios which are different from each other.

According to another aspect of the present invention, there is provided an image forming method for forming an image by developing an electrostatic image with light chromatic toner and dark chromatic toner which have the same hue, said developing device comprising a light color developing step of developing an electrostatic image by a developing device accommodating a developer containing the light chromatic toner and carrier; a dark color developing step of developing an electrostatic image by a developing device accommodating a developer containing the dark chromatic toner and carrier; a light color developer supplying step of supplying the light color developer from a light color developer supply container accommodating a developer containing the light chromatic toner and the carrier to said light color developing device; a dark color developer supplying step of supplying the dark color developer from a dark color developer supply container accommodating a developer containing the dark chromatic toner and the carrier to said dark color developing device; wherein the developer in said light chromatic toner supply container and the developer in said dark chromatic toner supply container have carrier weight ratios which are different from each other.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, a developing apparatus and an image forming apparatus, which are in accordance with the present invention will be described in detail with reference to the appended drawings.

Embodiment 1

Figure 1:
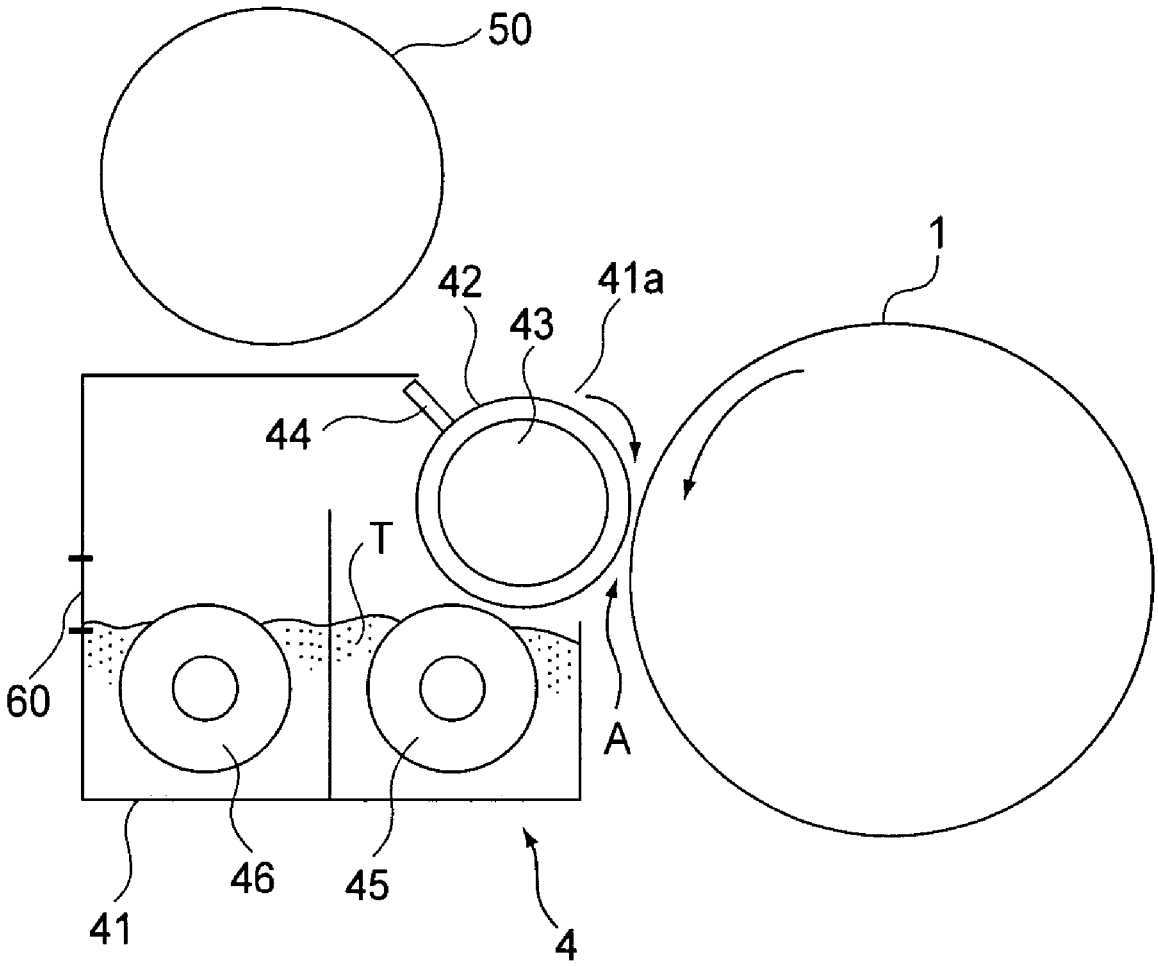
FIG. 1 is a drawing showing the general structure of the developing apparatus in the first embodiment of the present invention.
Figure 2:
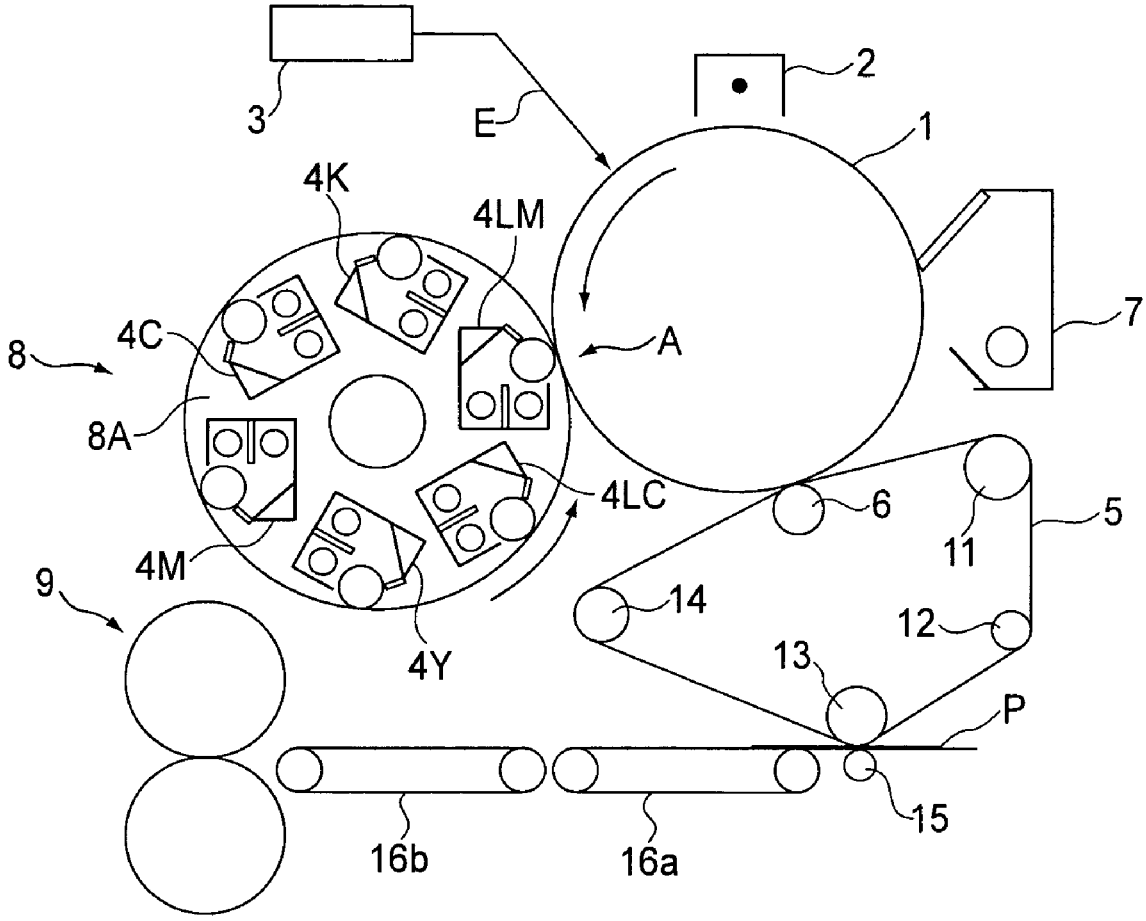
FIG. 2 is a drawing showing the general structure of the image forming apparatus in the first embodiment of the present invention.
Figure 3:
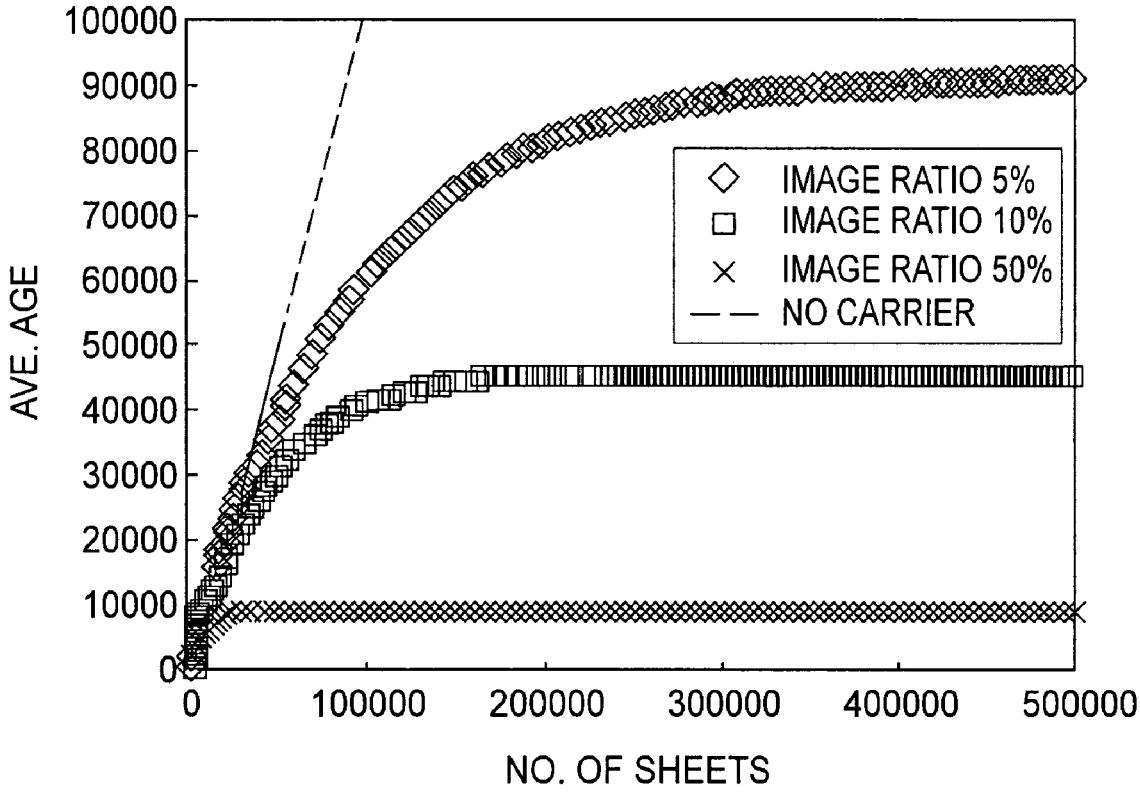
FIG. 3 is a graph showing the average carrier age.

FIG. 1 shows the general structure of the developing apparatus in the first embodiment of the present invention, and FIG. 2 shows the general structure of the image forming apparatus in the first embodiment of the present invention, which employs the developing apparatus shown in FIG. 1.

First, referring to FIG. 2, the general operation of the image forming apparatus in this embodiment will be described. The image forming apparatus has an electrophotographic photosensitive member, as an image bearing member, in the form of a drum, that is, a photosensitive drum. It also has a charging device 2, an exposing apparatus 3, and a developing apparatus 8 of the rotary type, which are disposed in the adjacencies of the peripheral surface of the photosensitive drum 1. Further, the image forming apparatus has an intermediary transfer belt 5 as an intermediary transferring member, which is stretched around, being thereby suspended by, rollers 11, 12, 13, and 14, in contact with the peripheral surface of the photosensitive drum 1.

The developing apparatus 8 of the rotary type is provided with a rotatable member 8A (which hereinafter will be referred to as development rotary), which is rotatably supported in a manner of opposing the peripheral surface of the photosensitive drum 1. Within the development roller 8A, multiple (six in this embodiment) developing devices 4 are disposed. They are: a light magenta developing device 4LM which contains toner of light magenta color; a light cyan developing device 4LC which contains toner of light cyan color; a yellow developing device 4Y which contains toner of yellow color; a dark magenta developing device 4M which contains toner of dark magenta color; a dark cyan developing device 4C which contains toner of dark cyan color; and a black developing device 4K which contains toner of black color.

First, the photosensitive drum 1 is charged across its peripheral surface by the charging device 2. Then, the charged peripheral surface of the photosensitive drum 1 is exposed to an optical image E projected from a laser exposing apparatus. As a result, an electrostatic latent image is formed on the peripheral surface of the photosensitive drum 1. This latent image is developed by a predetermined developing device. More specifically, the predetermined developing device, for example, the developing device 4LM, is moved into the development area A, in which the developing device 4LM opposes the peripheral surface of the photosensitive drum 1, by rotating the development rotary 8A in the direction indicated by an arrow mark. Then, the developing device 4LM is activated to develop the latent image on the peripheral surface of the photosensitive drum 1. As a result, an image is formed of the toner of light magenta color (which hereinafter will be referred to light magenta toner image), on the peripheral surface of the photosensitive drum 1.

Thereafter, the toner image on the peripheral surface of the photosensitive drum 1 is transferred onto the intermediary transfer belt 5 by the transfer bias from a primary transfer roller 6 as a primary transferring means. This process of transferring a toner image on the peripheral surface of photosensitive drum 1 onto the intermediary transfer belt 5 is repeated as many times as there are developing devices 4. As a result, multiple toner images different in color or color density are sequentially placed in layers on the intermediary transfer belt 5, effecting thereby a single full-color toner image on the intermediary transfer belt 5.

The six toner images on the peripheral surface of the photosensitive drum 1, which are different in color or color density, are transferred by a transfer roller 15 as a secondary transferring means onto a sheet of recording paper P as a recording medium. After the transfer of the toner images, the recording paper P is conveyed by conveyer belts 16*a* and 16*b* to a fixing device 9, in which it is subjected to pressure and heat. As a result, a permanent copy, or the recording paper P which is bearing a permanent full-color toner image, is obtained. The residual toner, that is, the toner remaining on the peripheral surface of the photosensitive drum 1 after the transfer is removed by a cleaner 7.

Next, referring to FIG. 1, the developing devices 4 (4LM, 4LC, 4Y, 4M, 4C, and 4K) will be described in detail. The developing devices 4LM, 4LC, 4Y, 4M, 4C, and 4K are different only in the color of the developers stored therein; they are identical in structure.

Each developing device 4 is provided with a developing means container 41, in which two-component developer T made up of nonmagnetic toner and magnetic carrier is stored.

The developing means container 41 is provided with an opening 41*a*, which faces the photosensitive drum 1, in the development area A. A development sleeve 42 as a developer carrying member is rotatably disposed so that it is partially exposed from the developing means container 41*a* through this opening 41*a*. The development sleeve 42 is formed of a nonmagnetic substance. Within the hollow of the development sleeve 42, a magnet 43 as a magnetic field generating means is stationarily disposed. The developing device 4 is also provided with stirring screws 45 and 46, which are disposed within the developing means container 41.

During a developing operation, the development sleeve 42 is rotated in the direction indicated by an arrow mark in FIG. 1, while picking up the two-component developer T in the developing means container 41. As the development sleeve 42 bearing the two-component developer T is further rotated, the developer T on the development sleeve 42 is regulated, in the amount per unit area, by a blade 44 as a developer regulating member, being thereby formed into a developer layer with a preset thickness. As the development sleeve 42 is further rotated, the uniform layer portion of the developer on the development sleeve 42 reaches the aforementioned development area A, in which the peripheral surface of the development sleeve 42 faces the photosensitive drum 1. As a result, the developer layer faces the photosensitive drum 1, developing thereby the latent image on the photosensitive drum 1. After developing the latent image on the photosensitive drum 1, the developer remaining on the photosensitive drum 1 is conveyed further by the further rotation of the development sleeve 42, and is recovered into the developing means container 41.

To the development sleeve 42, a development bias, which is a combination of a DC voltage and an AC voltage, is applied from an unshown development bias generating means. The AC component of the development bias is rectangular in waveform. For example, it is 2 kHz in frequency and 2 kV in peak-to-peak voltage (Vpp). This development bias forms an alternating electric field between the development sleeve 42 and photosensitive drum 1. The alternating electric field electrically separates toner particles from carrier particles, generating toner mist. As a result, the developing device 4 is improved in developmental efficiency.

To describe the two-component developer in more detail, the toner used in this embodiment is made up of resinous binder, which is essentially polyester, and pigment. It is roughly 8 μm in volume average particle diameter. It is obtained by classifying the particles produced by pulverizing the solid mixture obtained by kneading the mixture of the resinous binder and the pigment. The carrier used in this embodiment is particulate. Each carrier particle is made up of a core, which essentially is made up of ferrite, and silicon resin coated on the core. It is 40 μm in 50% particle diameter ($D_{50}$). The above-described toner and carrier are mixed at an approximate ratio of 8:92 to yield the two-component developer, which is 8% in toner content (TD ratio).

As for the manufacturing of the light and dark toners, which are the same in color, but different in color density, the light and dark toners are adjusted in pigment ratio so that after their adhesion to the transfer paper P (recording paper) at a rate of 5 mg/cm$^2$, the optical densities of the transfer paper P become 0.8 and 1.6, respectively. More specifically, in this embodiment, the light color toner (that is, light toner) was rendered ⅕ in pigment amount compared to the dark color toner (that is, dark toner).

Next, the features of the developing device 4, which characterizes this embodiment, will be described.

As the toner in the developing means container 41 is consumed by image formation, the developing means container 41 is replenished with the toner from a developer replenishment hopper 50 (or developer supply container) by the amount equal to the amount by which the toner in the developing means container 41 was consumed. The replenishment developer supplied from the developer replenishment hopper 50 is a mixture of toner and carrier. Thus, as the developing means container 41 is replenished with toner by the amount equal to the amount by which the toner in the container 41 was consumed, the developing means container 41*a* is also replenished with a fresh supply of carrier, increasing thereby in the amount of the carrier therein, by the amount equal to the amount of the fresh supply of carrier. In reality, however, as the fresh supply of carrier is added to the developer in the container 41, the developer in the container 41 is discharged through the developer discharge opening 60 in the wall of the developing means container 41 by the amount equal to the amount of the replenished carrier. The developer discharge opening 60 has been adjusted in position so that the amount of the two-component developer in the developing means container 41 stabilizes at 370 g. The developer discharged from the developing means container 41 is sent to a developer recovery screw (unshown) located in the center of the development rotary 8A, and then, is collected by the recovery screw into a waste developer bin (unshown). The developer replenishment hopper 50 (developer supply container) may be rendered replaceable by structuring it so that the developer replacement hopper 50 itself can be removably attached to the image forming apparatus main assembly, or it may be structured so that it is externally replenished with a fresh supply of developer.

In this embodiment, the dark toner for replenishment and the light toner for replenishment, that is, the dark toner to be filled into the corresponding developer replenishment hopper 50 and the light toner to be filled into the corresponding developer replenishment hopper 50, were rendered different in the weight ratio between the toner and carrier (ratio of carrier weight relative to entire weight of developer, which hereinafter will be referred to as "C/D ratio"). That is, the developer which contains the light toner was rendered smaller in the weight ratio of carrier than the developer which contains the dark toner.

More specifically, the weight ratios of the carrier in the light magenta (LM) developer and light cyan (LC) developer were set to 7.5%, whereas the weight ratios of the carrier in the dark magenta (M) developer and dark cyan (C) developer were set to 15%.

Prior to the starting of a developer replenishment operation, each replenishment developer hopper 50 was filled with 400 g of replenishment developer. In the hoppers 50 for the replenishment toners of the light magenta and light cyan, 370 g of toner and 30 g of carrier were placed, whereas in the hopper 50 for the replenishment toners of the dark magenta and dark cyan, 340 g of toner and 60 g of carrier were placed.

Rendering the dark and light toners different in the C/D ratio in the replenishment developer hopper 50 provides another benefit.

This benefit is that the light color developer in the replenishment developer hopper 50 is greater in the amount of the toner than the dark color developer in the replenishment developer hopper 50.

That is, normally, the amount by which the light toner is used is greater than the amount by which the dark toner is used, as described above. Thus, by increasing the amount of the light toner in the replenishment developer hopper 50, it becomes possible to extend the interval with which the developer hopper 50 for the light replenishment developer is replaced, or replenished with the light replenishment developer.

Figure 4:
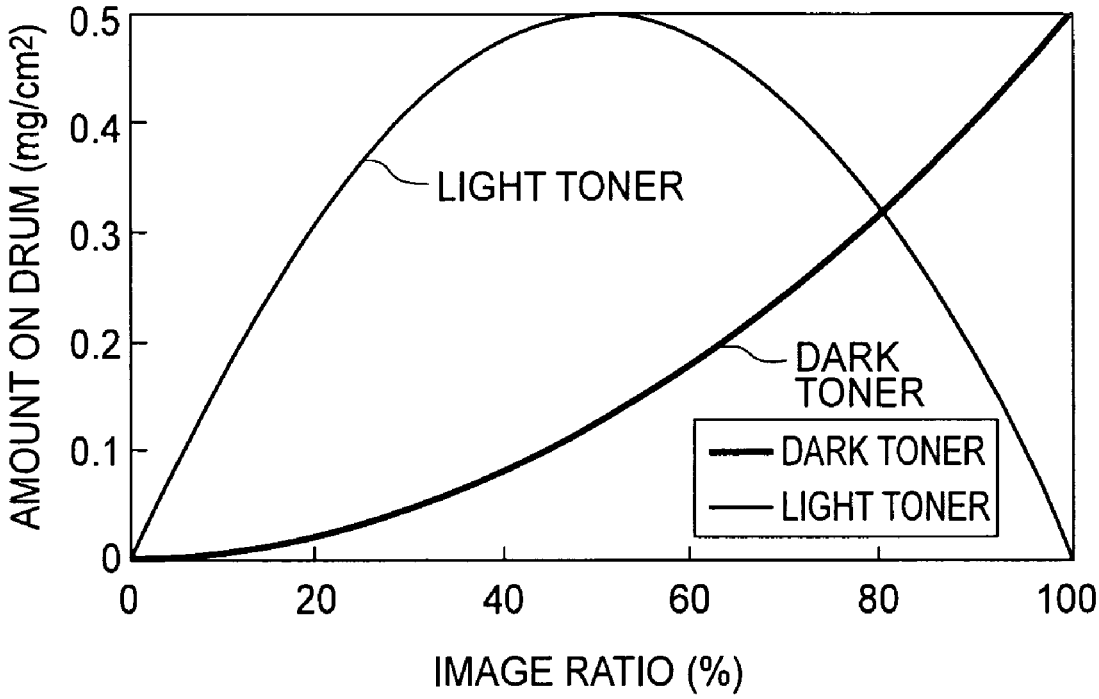
FIG. 4 is a graph showing the control carried out by the image formation system which uses dark and light toners, while a transitional area between an image area to be formed of the dark toner and an image area to be formed of the light toner is formed, and the amounts of the dark and light toner consumption.

Referring to FIG. 4, in this embodiment, where the image ratio was no more than roughly 60%, the amount by which the light toner was used was no less than twice the amount by which the dark toner was used. Further, the estimated average image ratio of an ordinary image forming carried out using dark and light toners is roughly 30%. Therefore, the average age of the carrier in the light developer becomes one half of that in the dark developer.

Obviously, the average image ratio is affected by a user and an image to be formed. Thus, the replenishment developers may be adjusted in C/D ratio in response to the changes in average image ratio. Further, the light magenta (LM) and dark magenta (M) developer may be rendered different in C/D ratio, and so may the light cyan (LC) developer and dark cyan (C) developer, which is obvious.

The following are the results of the analysis of the duration tests which are different in C/D ratio, and in which 40,000 copies were made. The amount of the changes in color density attributable to the changes in the amount of triboelectric charge are given as the amount of color deviation (color difference $\Delta E_{max}$). Given in Table 1 are the results of the duration tests. The indexes which are considered to be particularly important for the evaluation of the effects of the present invention are: the extent of color deviation, more specifically, the difference in color between a given point (area) of the first copy and the same point (area) of the last copy, which are formed by the same image forming apparatus; and the difference in color between a given point (area) of a copy of an image made by an image forming apparatus, and the same point (area) of a copy of the same image made by another image forming apparatus. Presently, research and development are being carried out to keep the value of the maximum color difference $\Delta E_{max}$ no higher than 4, preferably 3.

In the color difference evaluation mode, the developer in the developing device 4 was controlled so that its T/D ratio remained constant (8% in this embodiment), and image ratio was switched every 200th recording medium of A3 size (60%-solid white-60%- ). Then, the changes in color density were calculated, and were used as color differences, obtaining $\Delta E_{max}$. With the use of this mode, it is possible to examine the changes in color difference which occur as image ratio suddenly changes.

More specifically, with the use of this method, in a duration test in which image ratio is zero (solid white), the image forming apparatus is virtually idled. Therefore, it can be used to assess developer in terms of the charge-up. In comparison, a duration test in which image ratio is relatively high (70%) can be used to assess developer in terms of the triboelectric startup which is affected by the carrier deterioration.

As a color difference gauge, a Model 530 of X-rite Co., Ltd. was used. As for the color differences, a* and b* were measured at an optical density of roughly 1.0, and the color difference was calculated using: $\Delta E=[\{(a^*)^2+(b^*)^2\}^{1/2}-\text{initial value}]$.

Regarding the points of measurement, it has been confirmed, through experiments, that because the dark toner ratio was extremely small on the low density side of this measurement point, and greater on the high density side of this measurement point, the color deviation attributable to the control of the process of forming the aforementioned transitional areas of an image, using the dark and light toners, which has been problematic, was reduced. In this test, the color density was measured at points where image ratio was 60%, and the theoretical color density was roughly 1.0 (ratio between dark and light toners was 1:3).

As a result, the image formation system in this embodiment which uses light magenta (LM) and dark magenta (M) which were different in C/D ratio was smaller in color difference ($\Delta E_{max}$=4.1) than the image formation system in accordance with the prior art which used light magenta (LM) and dark magenta (M) which are the same in C/D ratio ($\Delta E_{max}$=6).

Table 1 shows only the results regarding the light magenta (LM) and dark magenta (M). Obviously, the results regarding the light cyan (LC) and dark cyan (C) were the same as those regarding the light magenta (LM) and dark magenta (M).

Further, this embodiment was described with reference to the structure of the image forming apparatus employing the developing apparatus of the rotary type. However, even if the present invention is applied to an image forming apparatus of the tandem type, that is, an image forming apparatus in which multiple image formation stations are horizontally or vertically stacked in parallel, there will be no problem.

Moreover, in order to allow a user to choose between the productivity mode and high quality mode, the image forming apparatus in this embodiment may be structured so that it can be operated in the four color (yellow Y, magenta M, cyan C, and black K) mode as a productivity mode, and also, in the six color (light magenta LM, light cyan LC, yellow Y, magenta M, cyan C, and black K) mode as a high quality mode. With the provision of such operational modes, it is possible to balance the amount of toner consumption against productivity according to user's needs.

TABLE 1

| | | | Max. Color Difference in the color difference evaluation mode | | |
|---|---|---|---|---|---|
| | | | 60% | 0% | 60% |
| Conventional | LM | 15% | 5.5 | 5.2 | 6.5 |
| Embodiment 1 | LM | 7.5% | 3.4 | 3.5 | 4.1 |

Embodiment 2

In this embodiment, the C/D ratio of the light toner filled in the replenishment developer hopper 50 was further reduced from 7.5% to 5%. The results of the duration tests are given in Table 2.

When the C/D ratio was 5%, the amount of the carrier in the replenishment developer was such an amount that stabilized the developer in carrier deterioration level in a duration test in which image ratio is 60%. As a result, better results than those obtained in the first embodiment were obtained; it was possible to achieve the target value of 3.1 ($\Delta E_{max}$=3.1). Further, the amount by which toner could be placed in the replenishment developer hopper 50 was greater by 40 g compared to that in the developing device in accordance with the prior art. Thus, assuming that the image ratio in the average usage is 30%, the replacement intervals can be extended by a value equivalent to 150 copies of A3 size.

TABLE 2

| | | | Max. Color Difference in the color difference evaluation mode | | |
|---|---|---|---|---|---|
| | | | 60% | 0% | 60% |
| Conventional | LM | 15% | 5.5 | 5.2 | 6.5 |
| Embodiment 1 | LM | 7.5% | 3.4 | 3.5 | 4.1 |
| Embodiment 2 | LM | 5% | 3.0 | 2.8 | 3.1 |

Regarding the above-described first and second embodiments, a developing apparatus may be designed so that the image ratio of an image forming operation is calculated by obtaining the video count (for example, cumulative length of time beam of laser light was emitted); the ratio of the light toner usage is obtained based on the calculated image ratio, with reference to FIG. 4, which shows the characteristics of the developing apparatus; and a toner container, the C/D ratio of which matches the obtained light toner usage, is selected for image formation. In this case, an image forming apparatus may be designed so that the main assembly, for example, of an image forming apparatus is provided with multiple toner containers different in C/D ratio, and when container replacement is necessary, an optimal toner container is automatically selected from among the multiple toner containers; or so that the apparatus main assembly displays the optimal C/D ratio, and a user is to mount into the main assembly, a toner container, the C/D ratio value of which matches the displaced optimal C/D ratio.

Further, the above-described first and second embodiments may be modified so that in order to reduce the average age of the carrier in a developing means container, an adjustment may be made to reduce the developer in absolute amount. This modification is intended to lower the average age of the carrier in the developing means container by shortening the developer replacement intervals by reducing the amount of the developer in a developing means container. For example, referring to FIG. 4, when an image forming apparatus is roughly 30% in average image ratio, there is roughly eight times difference in usage between the dark and light toners (light toner is used eight times more than dark toner). Therefore, theoretically, a developing means container which contains the light developer and a developing means container which contains the dark developer can be rendered roughly the same in average carrier ages, by giving the former a developer capacity of 400 g, and the latter a developer capacity of 50 g, provided that the light and dark developers are the same in carrier ratio.

In consideration of the above-described points, it is when the ratio of the amount of the developer in a developing means container for the light toner, relative to that for the dark toner, is no more than the ratio of the light toner usage to the dark toner usage when image ratio is at the estimated average level, that the structural arrangement, in accordance with the present invention, which renders replenishment developer containing light toner lower in carrier ratio than replenishment developer containing dark toner, is effective. For example, when an image forming operation is 30% in average image ratio, the light toner usage is eight times the dark toner usage. Therefore, as long as the amount of the developer in a developing means container for light toner is no more than eight times that in a developing means container for dark toner, the present invention is effective.

Embodiment 3

In the field of an ordinary image forming apparatus, it is common practice to carry out the operation in which Min (Y, M, and C) (that is, minimum value among Y, M, and C) is calculated from yellow (Y), magenta (M), and cyan (C) signals, and the obtained values are used to control the process of forming an image of black toner, and the UCR operation, that is, the operation in which the amounts by which the yellow, magenta, and cyan toners are adhered to recording medium are reduced by the amount equal to the amount by which the amount by which black toner is adhered recording medium is increased.

This practice is carried out because it can reduce the amount by which cyan, magenta, and yellow toners are used. Further, it can yield such a full-color image, the black areas of which appears crisper and deeper than the black areas of a full-color image formed of three toners of primary colors, that is, the black areas made up of process black. However, if the areas of a black toner image, which correspond to the highlighted areas of a target full-color image, are excessive in density, it results in the formation of a full-color image, the highlighted areas of which are shadowy. Ordinarily, therefore, control is executed to minimize in density the areas of the black toner image, which correspond to the highlighted areas of the target full-color image.

Thus, in this embodiment, the present invention is applied to an image forming method in which in place of the light magenta toner and light cyan toner as light toners, light black (LK) toner, that is, black toner reduced in tinting power, was used.

More specifically, the light magenta developing device and light cyan developing device were removed from the image forming apparatus used in the second embodiment, and a light black developing device was placed in the space where the light magenta developing device had been. In other words, the developing apparatus 8 was provided with a developing device containing light black toner, a developing device containing yellow toner, a developing device containing magenta toner, a developing device containing cyan toner, and a developing device containing black toner.

Therefore, it was possible to control an image forming operation while aggressively using the UCR across the highlighted areas of an image, substantially improving the image forming apparatus in terms of the above-described problems.

In this embodiment, replacing the development rotary in the second embodiment, in which up to six developing devices can be mounted, with a development rotary capable of holding only five developing devices, although it is not shown in the drawings, makes it possible to form an image without skipping. Further, the employment of a development rotary capable of holding up to seven developing devices makes it possible to use a light magenta developing device, a light cyan developing device, and light black developing device, in addition to t he above mentioned five developing devices, so that various images different in specifications can be formed to satisfy various needs of a user.

While the invention has been described with reference to the structures disclosed herein, it is not confined to the details set forth, and this application is intended to cover such modifications or changes as may come within the purposes of the improvements or the scope of the following claims.

This application claims Convention Priority from Japanese Patent Application No. 374426/2004 filed Dec. 24, 2004 which is hereby incorporated by reference.

What is claimed is:

1. A developing apparatus for developing an electrostatic image with light chromatic toner and dark chromatic toner which have the same hue, the developing apparatus comprising:

a light color developing device for accommodating a developer containing the light chromatic toner and a carrier to develop the electrostatic image;

a dark color developing device for accommodating a developer containing the dark chromatic toner and a carrier to develop the electrostatic image;

a light color developer supply container accommodating a developer containing the light chromatic toner and the carrier to be supplied to said light color developing device; and a dark color developer supply container accommodating a developer containing the dark chromatic toner and the carrier to be supplied to said dark color developing device, wherein the developer in said light chromatic toner supply container and the developer in said dark chromatic toner supply container have carrier weight ratios which are different from each other.

2. An apparatus according to claim 1, wherein the light chromatic toner contains a pigment such that toner exhibits an optical density of less than 1.0 per 0.5 $mg/cm^2$ of the toner on a transfer material onto which a toner image of the light chromatic toner is transferred, and wherein the dark chromatic toner contains a pigment such that toner exhibits an optical density of not less than 1.0 per 0.5 $mg/cm^2$ of the toner on a transfer material onto which a toner image of the dark chromatic toner is transferred.

3. An apparatus according to claim 1, wherein a weight ratio of the carrier in the developer in said light chromatic toner supply container is smaller than a weight ratio of the carrier in the developer in said dark chromatic toner supply container.

4. An apparatus according to claim 1, wherein in a state before a supplying operation, a weight of the toner in the developer in said light chromatic toner supply container is different from a weight of the toner in the developer in said dark chromatic toner supply container.

5. An image forming method for forming an image by developing an electrostatic image with light chromatic toner and dark chromatic toner which have the same hue, image forming method comprising:

a light color developing step of developing an electrostatic image by a developing device accommodating a developer containing the light chromatic toner and a carrier;

a dark color developing step of developing an electrostatic image by a developing device accommodating a developer containing the dark chromatic toner and a carrier;

a light color developer supplying step of supplying the light color developer from a light color developer supply container accommodating a developer containing the light chromatic toner and the carrier to said light color developing device;

a dark color developer supplying step of supplying the dark color developer from a dark color developer supply container accommodating a developer containing the dark chromatic toner and the carrier to said dark color developing device, wherein the developer in said light chromatic toner supply container and the developer in said dark chromatic toner supply container have carrier weight ratios which are different from each other.

6. A method according to claim 5, wherein the light chromatic toner contains a pigment such that toner exhibits an optical density of less than 1.0 per 0.5 mg/cm$^2$ of the toner on a transfer material onto which a toner image of the light chromatic toner is transferred, and wherein the dark chromatic toner contains a pigment such that toner exhibits an optical density of not less than 1.0 per 0.5 mg/cm$^2$ of the toner on a transfer material onto which a toner image of the dark chromatic toner is transferred.

7. A method according to claim 5, wherein a weight ratio of the carrier in the developer in said light chromatic toner supply container is smaller than a weight ratio of the carrier in the developer in said dark chromatic toner supply container.

8. A method according to claim 5, wherein in a state before a supplying operation, a weight of the toner in the developer in said light chromatic toner supply container is different from a weight of the toner in the developer in said dark chromatic toner supply container.

* * * * *

UNITED STATES PATENT AND TRADEMARK OFFICE

CERTIFICATE OF CORRECTION

PATENT NO. : 7,277,649 B2
APPLICATION NO. : 11/314091
DATED : October 2, 2007
INVENTOR(S) : Fumitake Hirobe et al.

It is certified that error appears in the above-identified patent and that said Letters Patent is hereby corrected as shown below:

COLUMN 4:
Line 37, "ration" should read --ratio--.

COLUMN 7:
Line 47, "to" should read --to as--.

COLUMN 8:
Line 20, "container 41a" should read --container 41--.

COLUMN 9:
Line 28, "41a is" should read --41 is--.

COLUMN 10:
Line 3, "hopper" should read --hoppers--.

COLUMN 13:
Line 28, "appears" should read --appear--; and
Line 67, "t he" should read --the--.

COLUMN 15:
Line 3, "device;" should read --device; and--.

Signed and Sealed this

Twenty-fourth Day of June, 2008

JON W. DUDAS
*Director of the United States Patent and Trademark Office*